US005702239A

United States Patent [19]

Yang

[11] Patent Number: 5,702,239

[45] Date of Patent: Dec. 30, 1997

[54] AIR PUMP WITH DUAL AIR INTAKES

[76] Inventor: Hsi-Kung Yang, No. 20, Lane 164, Yang-Ming Street, Pan-Chiao, Taipei Hsien, Taiwan

[21] Appl. No.: 779,122

[22] Filed: Jan. 6, 1997

[51] Int. Cl.[6] ..... F04R 1/00

[52] U.S. Cl. ..... 417/512; 417/526

[58] Field of Search ..... 417/512, 526

[56] References Cited

U.S. PATENT DOCUMENTS 3,904,325 9/1975 Olofsson et al. ..... 417/512

5,102,052 4/1992 Demarest et al. ..... 417/526 X

*Primary Examiner*—Richard E. Gluck

*Attorney, Agent, or Firm*—Beveridge DeGrandi Weilacher & Young, LLP

[57] ABSTRACT

An air pump with dual air intakes includes a pump body having an enclosed end with a securing point at its inner side for retaining a diaphragm, and an open end connecting to a cover. The cover has a securing point at its inner side for retaining a diaphragm. The cover and the enclosed end are provided with multiple air inlets. The diaphragms may cover the air inlets. The cover has a central hole through which a piston rod passes. A piston is connected to an inner end of the piston rod and is provided with an annular groove with through holes communicating with the piston rod. The annular groove is fitted with an annular gasket. A pump head is connected to a projected end of the piston rod. The pump head is connected to an air outlet and a check valve communicating with the piston rod. When the piston displaces, air is drawn in via the ends of the pump body through the annular gasket and the annular groove into the piston rod via the through holes and is then discharged via the check valve and the air outlet.

2 Claims, 5 Drawing Sheets

AIR PUMP WITH DUAL AIR INTAKES

BACKGROUND OF THE INVENTION

1. Field of the Invention

The present invention relates generally to an air pump, and more particularly to an air pump with dual air intakes.

2. Description of the Prior Art

Referring to FIG. 5, it shows a conventional air pump capable of unidirectional intake and discharge of air. The conventional air pump shown in FIG. 6 makes use of a piston to achieve bidirectional air discharge. However, its structure is very complicated and it does not provide bidirectional air intake. The pumping operation is also not smooth since the pressure at one end will be greater than that at the other end.

SUMMARY OF THE INVENTION

Accordingly, a primary object of the present invention is to provide an air pump with dual air intakes in which a diaphragm and multiple air inlets are provided at either end of the pump body and, by means of the motion of the piston rod, each stroke will drawn in air and discharge air.

To achieve the above object, the air pump of the present invention essentially comprises a pump body having an enclosed end with securing point at its inner side for retaining a diaphragm, and an open end connecting to a cover. The cover has a securing point at its inner side for retaining a diaphragm. The cover and the enclosed end are provided with multiple air inlets. The diaphragms may cover the air inlets. The cover has a central hole through which a piston rod passes. A piston is connected to an inner end of the piston rod and is provided with an annular groove with through holes communicating with the piston rod. The annular groove is fitted with an annular gasket. A pump head is connected to a projected end of the piston rod. The pump head is connected to an air outlet and a check valve communicating with the piston rod. When the piston 4 displaces, air is drawn in via the ends of the pump body through the annular gasket and the annular groove into the piston rod via the through holes and is then discharged via the check valve and the air outlet.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
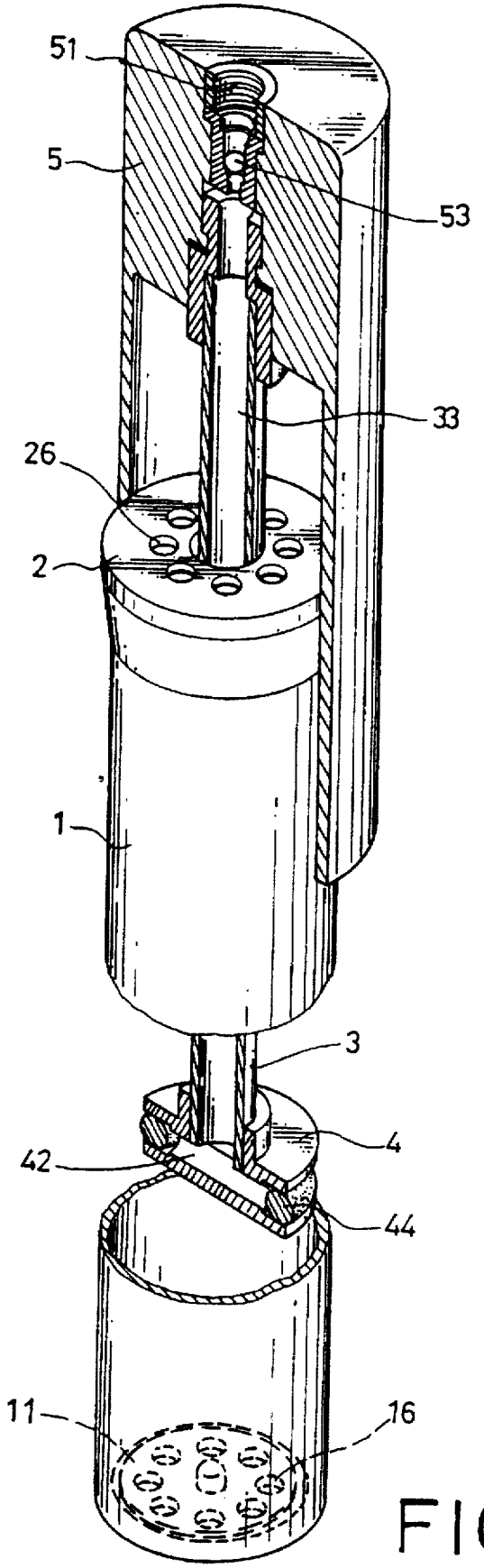
FIG. 1 is an elevational view of the present invention.
Figure 2:
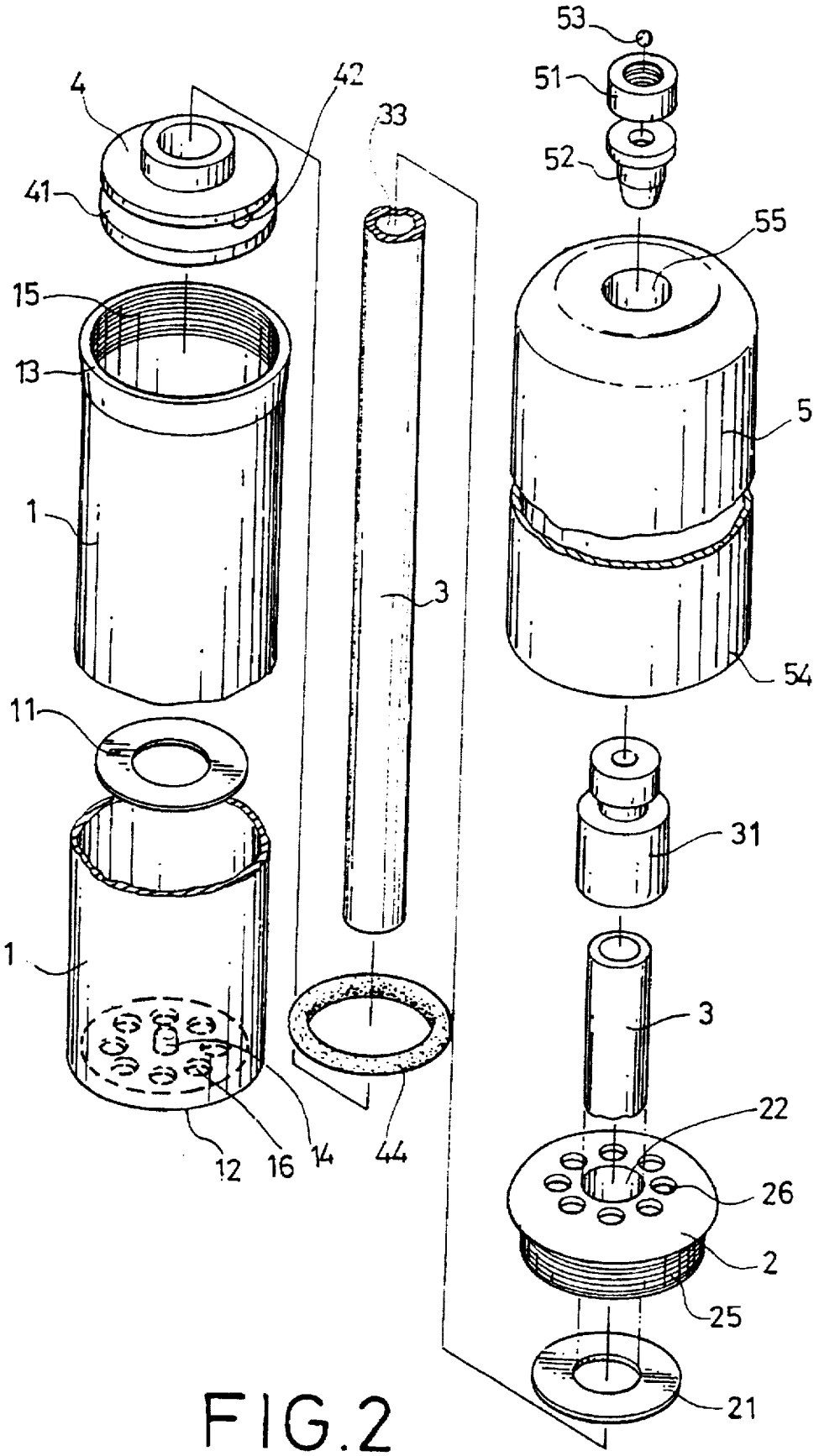
FIG. 2 is an elevational exploded view of the present invention.

The present invention is directed to a pump with dual air intakes. With reference to FIGS. 1 and 2, it essentially comprises a hollow cylindrical pump body 1, a cover 2, a piston rod 3, a piston 4, a pump head 5, an air outlet 51, a check valve 52, and two diaphragms 11, 21.

The pump body 1 has one enclosed end 12 and one open end 13. A securing point 14 is disposed at an inner side of the enclosed end 12. The open end 13 is provided with inner threads 15. The cover 2 is provided with outer threads 25 at its periphery. The cover 2 is coupled to the pump body 1; that is, the inner threads 15 engage the outer threads 25. The cover 2 is also provided with a securing point 24 at an inner side thereof. The enclosed end 12 is provided with a plurality of air inlets 16. The cover 2 is also provided with a plurality of air inlets 26. The cover 2 further has a central hole 22 at its center. The diaphragms 11, 21 are respectively retained on the securing points 14 of the pump body 1 and 24 of the cover 2 such that the centers thereof are respectively secured at the inner side of the ends of the pump body 1 and they can cover the corresponding air inlets.

The piston is connected to one end of the hollow piston rod 3 and is provided with an annular groove 41 at its periphery. The annular groove 41 has a plurality of through holes 42 connecting a hollow interior 33 of the piston rod 3. The annular groove 41 is fitted with an annular gasket 44. The piston rod 3 has one end passing through the central hole 22 of the cover 2 into the pump body 1 to place the piston 4 inside the pump body 1 before the cover 2 is locked onto the pump body 1.

The pump head 5 is connected to the other end of the piston rod 3, which uses a sleeve block 31 to secure within a through passage 55 of the pump head 5. The center of the pump head 5 is the through passage 55 in which an air outlet 51 located at the outer side and the check valve 52 located at the inner side are provided. The check valve 52 communicates with the hollow interior 33 of the piston rod 3. The check valve 52 is a conical passage having a valve ball 53 in the middle. By means of the displacement of the valve ball 53, air can only exit through the air outlet 51 into which no air can be drawn, that is, unidirectional check. The pump head 5 has a sleeve portion 54 extending in the direction of the other end to cover part of the pump body 1 and to serve as the handle. But there is a clearance between the sleeve portion the pump body 1, and the pump head 5 will not cover the air inlets of the cover 2. Air travels along the path between the sleeve portion 54 and the pump body 1 to the air inlets of the cover 2 so as to provide a larger space to facilitate pumping. The air outlet 51 is internally provided with inner threads to facilitate connection with a pump pin or the outer threads of a tire nozzle. To enhance the security of the pump, it may also be connected to an extension tube to facilitate the pumping process.

Figure 3:
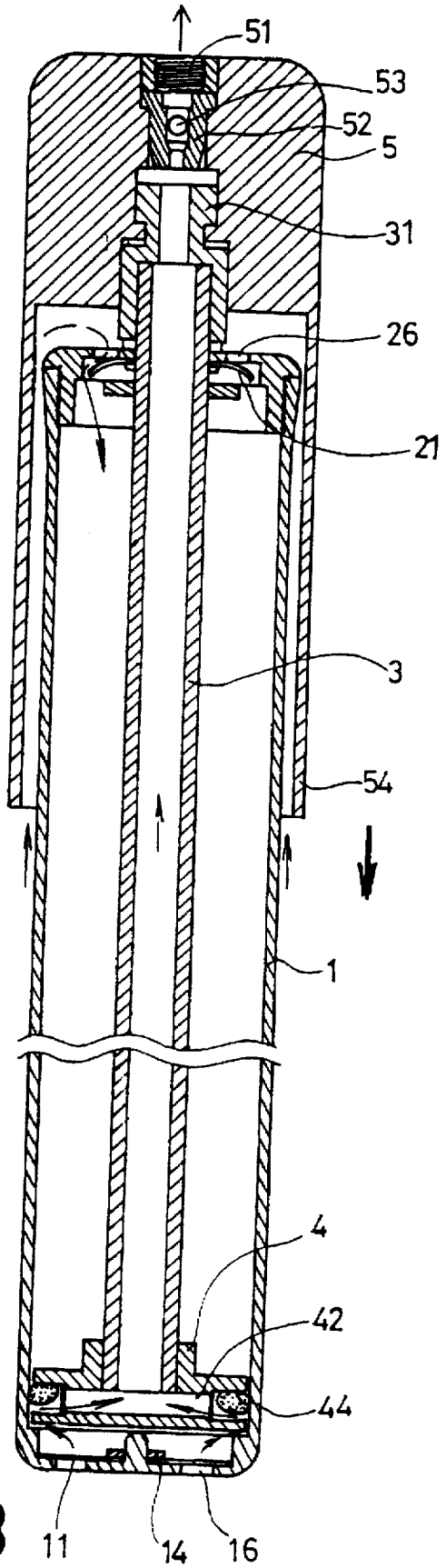
FIG. 3 is a sectional view of the present invention.
Figure 4:
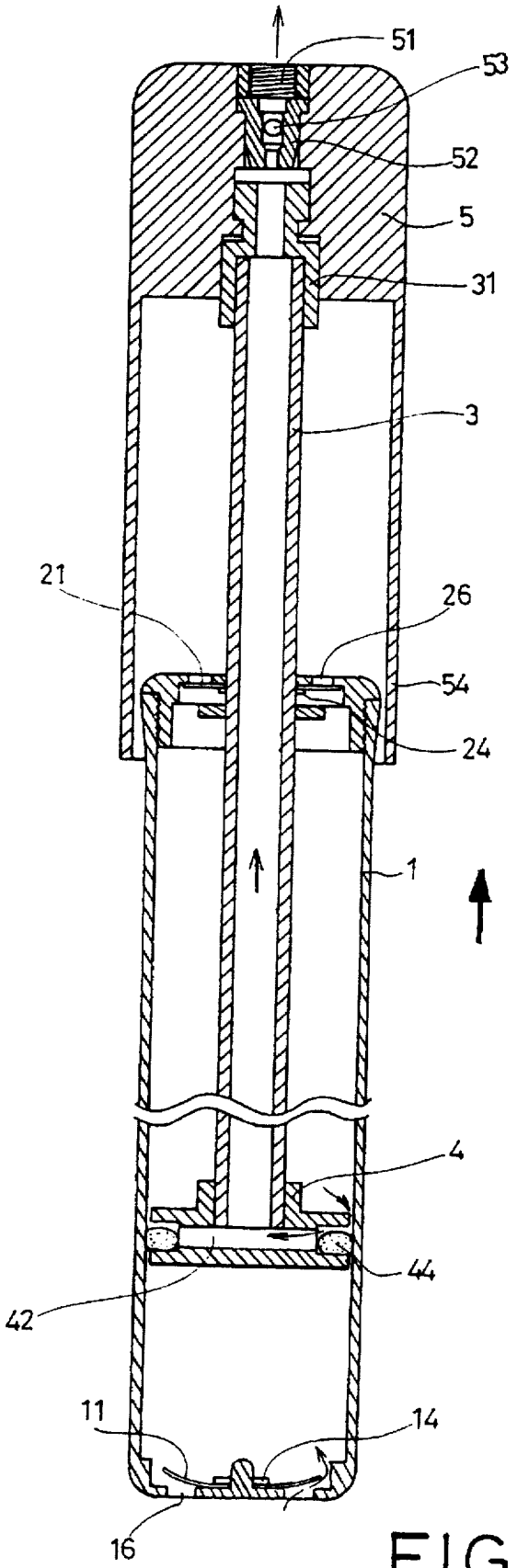
FIG. 4 is a sectional view of the preferred embodiment of the present invention in a different position.
Figure 5:
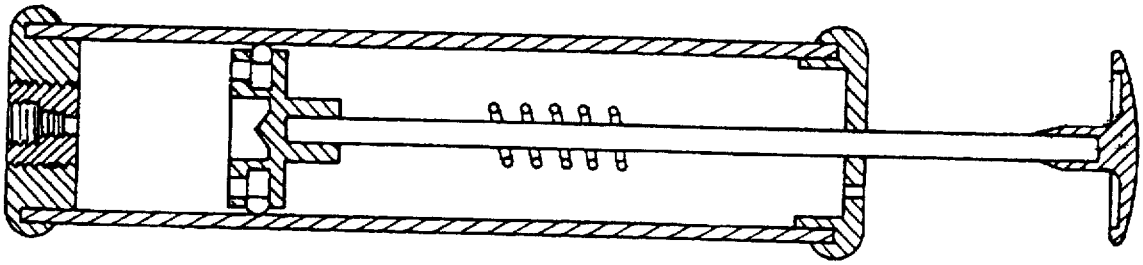
FIG.5 (PRIOR ART)
FIG. 5 is a sectional view of a conventional air pump.
Figure 6:
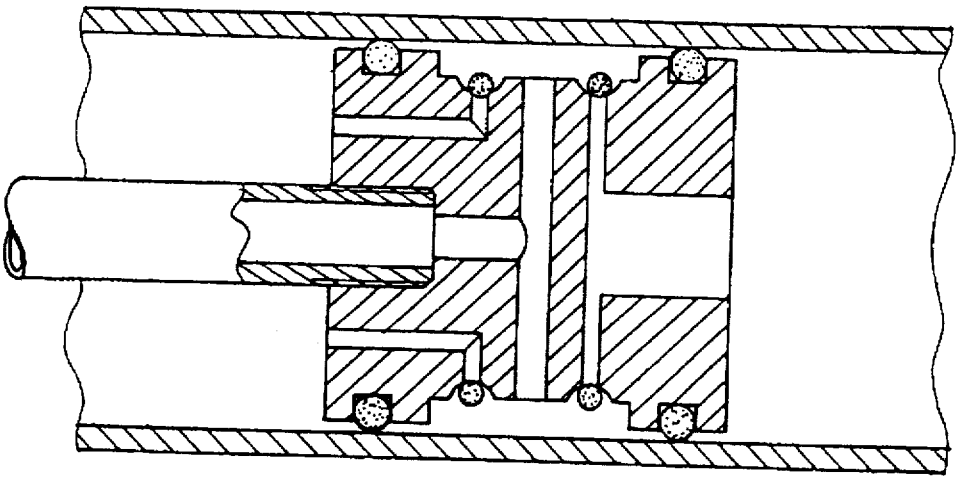
FIG.6 (PRIOR ART)
FIG. 6 is a sectional view of another conventional air pump.

With reference to FIG. 3, when the piston 4 displaces near the cover 2, the diaphragm in the cover 2 is drawn open so that air enters the pump body 1 via the air inlets of the cover 2. At this time, the air at the other half of the pump body 1 which is not drawn in is subjected to pressure so that the diaphragm at the enclosed end of the pump body 1 is tightened, and air enters via the space between the annular gasket and the annular groove through the through hole into the piston rod 3. Since the annular gasket will deviate to one side during displacement of the piston 4, it is shown to deviate near the cover 2 in the drawing, air just entering from the other end may be presented from rushing thereinto. Therefore, air escapes from the piston 4 to the hollow piston rod 3 and to the check valve 52 of the pump head 5 and out through the air outlet. By means of this arrangement, while air escape out of one end, air is drawn in from the other end. Referring to FIG. 4, when the piston 4 displaces near the cover 2, the diaphragm at the enclosed end of the pump body 1 is drawn open so that air may enter via the air inlets of the cover 2. The previously drawn air then escapes via the piston 4, the piston rod 3 and the pump head 5. Pumping may thus be very quick as a result of this cycling of air.

The major effects of the present invention essentially reside in that the diaphragms at the ends of the pump body 1 are drawn open due to displacement of the piston 4 so that air enters via the space between the annular gasket and the annular groove into the piston rod 3 and out through the check valve 52 and the air outlet. In this way, so long as the pump head 5 is worked, pumping is achieved.

Although the present invention has been illustrated and described with reference to the preferred embodiment thereof, it should be understood that it is in no way limited to the details of such embodiment but is capable of numerous modifications within the scope of the appended claims.

What is claimed is:

1. An air pump having dual air intakes, comprising:

a pump body having an enclosed end with a securing point at the center of an inner side thereof and an open end provided with inner threads, said enclosed end having a plurality of air inlets defined therethrough;

a cover having outer threads at its periphery, said cover connecting to said open end of said pump body, said cover having a securing point at its inner side and being provided with a plurality of air inlets, said cover further having a central hole defined therethrough;

two diaphragms, one of which has a diameter slightly smaller than the inner diameter of said pump body and is connected to the inner side of said enclosed end of said pump body to be retained by said securing point of said enclosed end, the other of which has a diameter slightly smaller than the inner diameter of said cover and is connected to the inner side of said cover to be retained by said securing point of said cover, both of said diaphragms covering said air inlets;

a piston rod, said piston rod being a hollow tube having one end passing through said central hole of said cover into said pump body;

a piston connecting to an inner end of said piston rod, said piston being placed inside said pump body and having an annular groove at its periphery, said annular groove being provided with a plurality of through holes communicating with said piston rod;

an annular gasket received in said annular groove of said piston, said annular gasket displacing with said piston to locate at a position opposite to that of the direction of displacement;

a pump head connecting to a projected end of said piston rod, said pump head having a passage in the middle and not covering said air inlets of said cover;

an air outlet in communicating with an outer side of said passage of said pump head; and a check valve connected to an inner side of said passage of said pump head and communicating with said piston rod, whereby when said pump head is worked to cause said piston to reciprocate within said pump body, said piston displaces away from said cover so that said diaphragm of said cover is opened, drawing air in via said air inlets of said cover, with said diaphragm of said pump body being closed, air at that part then travels via said piston and said piston rod to escape through said air outlet and said piston displaces near said cover so that said diaphragm of said pump body is opened, drawing air in via said air inlets of said pump body, with said diaphragm of said cover being closed, air at that part then travels via said piston and said piston rod to escape through said air outlet, thus accomplishing cycles of continuous air intake by said air inlet of said cover and said air inlet of said pump/body alternately, while accomplishing cycles of continuous air discharge by said air outlet of said piston rod.

2. A air pump with dual air intakes as claimed in claim 1, wherein said pump head is provided with a sleeve portion extending in the direction of said pump body, and a clearance is defined between said pump body and said sleeve portion.

* * * * *